US009527320B2

(12) United States Patent
Shelhart et al.

(10) Patent No.: US 9,527,320 B2
(45) Date of Patent: Dec. 27, 2016

(54) INKJET PRINT HEAD PROTECTION BY ACOUSTIC SENSING OF MEDIA

(71) Applicant: Xerox Corporation, Norwalk, CT (US)

(72) Inventors: Timothy G. Shelhart, West Henrietta, NY (US); Aaron M. Moore, Fairport, NY (US); Samuel P. Sadtler, Brooklyn, NY (US); Donald R. Fess, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/694,005

(22) Filed: Apr. 23, 2015

(65) Prior Publication Data

US 2016/0311237 A1 Oct. 27, 2016

(51) Int. Cl.
*B41J 11/00* (2006.01)
*B41J 25/308* (2006.01)
*B41J 2/01* (2006.01)

(52) U.S. Cl.
CPC ..... *B41J 25/308* (2013.01); *B41J 2/01* (2013.01)

(58) Field of Classification Search
CPC ..... G01B 21/08
See application file for complete search history.

(56) References Cited

U.S. PATENT DOCUMENTS 5,806,992 A * 9/1998 Ju ..... 400/56
5,852,232 A * 12/1998 Samsavar ..... B82Y 35/00 73/105
6,485,205 B2 * 11/2002 Luque ..... 400/56
6,666,537 B1 * 12/2003 Kelley et al. ..... 347/8
7,319,521 B2 * 1/2008 Typpoe ..... D21F 7/06 356/430
7,360,853 B2 * 4/2008 Barss ..... 347/8
7,847,943 B2 * 12/2010 Hellstrom ..... G01B 7/023 250/559.27
8,251,470 B2 * 8/2012 Bastardas et al. ..... 347/8
8,727,469 B2 * 5/2014 Hattori et al. ..... 347/8
2009/0227870 A1 * 9/2009 Kolkman ..... A61B 5/0095 600/447
2014/0098153 A1 * 4/2014 Moore et al. ..... 347/16

* cited by examiner

*Primary Examiner* — Stephen Meier
*Assistant Examiner* — John P Zimmermann
(74) *Attorney, Agent, or Firm* — BudzynFortunato IP Law, LLC

(57) ABSTRACT

A print head protection system is used in connection with an inkjet printer having a print head adapted for elevating, and a belt moving over a platen. A plurality of acoustic sensors is arrayed transversely to the process direction. The acoustic sensors measure a combined thickness of the belt, the platen, and the media sheet. An analyzer will detect if the media sheet is in contact with the media transport. An error signal is created when the thickness is below a predetermined value, indicating the media sheet is not in contact with the media transport. A mitigation control is operative to mitigate print head damage in response to the signal. Printing is halted in response to the signal to preclude damage to the print head. The sheet is discarded.

23 Claims, 7 Drawing Sheets

INKJET PRINT HEAD PROTECTION BY ACOUSTIC SENSING OF MEDIA

INCORPORATION BY REFERENCE

Not applicable.

TECHNICAL FIELD

This invention relates to inkjet digital printing machines, and, more particularly, to an apparatus, system, and method for protecting the printing head from damage due to impaction of media sheets by measuring media distortion with acoustic/ultrasonic sensors and analysis.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

FIG. 1 shows a state-of-the-art inkjet digital printing machine 20. Printer 20 includes a marking module or engine 22 having an ink jet print head or multiple print heads 23, disposed centrally on the marking engine 22, and facing downward. Printer 20 has a media path 24 along which the media sheet 34 moves. Printer 20 has a media path entrance 26 where sheets are fed into the printer by a media sheet feeder (not shown). Printer 20 also has a media path exit 28 where sheets leave the printer and are fed into a finisher (not shown). Printer 20 has an inverter 30 to turn the sheet over for duplex printing. A media sheet 34 leaving the inverter 30 follows arrow 32 back to the marking engine 22 for printing on the reverse side. Arrow 42 indicates the process path direction, which is downstream from entrance 26 toward exit 28.

In cut sheet printing devices, under certain conditions, the lead-edge of the paper can curl up and have potential for separating from the marking transport and contact the print head. A sheet with out-of-spec flatness can occur when a duplexed sheet has a heavy ink image on the trail edge of side 1, which then becomes the lead edge when inverted and curls towards Side 2. This is most severe when the paper is thin, and the cross-process direction image is parallel to the grain direction of the paper (Example: letter size paper, grain-long, long-edge-feed).

In direct-to-paper ink jet marking engines, an ink jet print head is mounted such that the face (where the ink nozzles are located) is mounted a fixed distance from the surface of the media. The gap is typically 1 mm or less. Because the paper curl height can be several millimeters, it poses a risk to the print head because it can hit the print head face plate when it passes through the nominally thin gap that the print heads are spaced from the media.

Media sheets, typically paper, can curl or distort in several ways. LE curl is a concave upward bending along the process direction, such that the lead edge (LE) and the trail edge (TE) rise up off the transport, as shown in FIG. 2. The raised LE can impact multiple print heads across the paper width. Cross curl is a concave upward bending across the process direction, such that the left side and right side edges rise up off the transport, as shown in FIG. 3. The raised sides can impact multiple print heads. Both LE curl and cross curl are caused by ink on the first side of a duplex print that is inverted.

Dog ear is a crease with upward bending across the process direction at an angle across a corner, as shown in FIG. 4. The crease can impact multiple print heads downstream. This is caused by sheet damage in the paper path. Print head damage is severe due to greater pressure.

Cockle is multiple bumps or peaks distributed throughout the sheet, as shown in FIG. 5. The bumps can impact multiple print heads downstream. Cockle is caused by the drying rate of ink, especially aqueous based inks.

For ideal image quality, the print head gap or distance of the print head to the sheet should be maintained at less than 1.2 mm, preferably within 1 mm. The media sheet traveling at one meter per second must pass freely under the print heads. The sheet must not contact the face of the print head, or serious damage will result. This requirement poses a challenge for cut sheet media since the corners, edges and body of the sheet may not be completely flat. The use of a hold down transport such as a vacuum conveyor helps to maintain the sheet flat and within the gap for the most part. Purposely delivering sheets with downward curl from the sheet supply tray also helps to hold the sheet flat. Nevertheless it is not guaranteed that a sheet is flat over the entire surface.

Ink jet print heads are very delicate and can easily be damaged if the face of the print head is contacted by the media which is passing nearby. The print heads are also very expensive. Thus, it is very important to minimize any risk of damaging these print heads.

Accordingly, there is a need to provide a print head protection device for inkjet printers that will detect media sheet curl and take remedial action to prevent print head damage.

There is a further need to provide a print head protection device for inkjet printers of the type described and that will match the high production rate of a digital printing machine.

There is a yet further need to provide a print head protection device for inkjet printers of the type described and that is mechanically simple and robust, thereby minimizing cost.

SUMMARY

In one aspect, a print head protection system is for use in connection with an inkjet printer having an inkjet print head, which is adapted for elevating. A media sheet has a lead edge and a trail edge. The media sheet moves in a process direction along a process path. The print head protection system comprises a media transport for conveying the media sheet along the process path, and for holding the media sheet generally flat.

At least one acoustic sensor is disposed beneath the media transport and upstream of the print head. The acoustic sensor is adapted to acoustically measure a combined thickness of the media transport and the media sheet. An analyzer is operatively connected to the acoustic sensor for analyzing the combined thickness of the media transport and the media sheet. The analysis will detect if the media sheet is in contact with the media transport. The analysis will create an error signal when the media sheet is not in contact with the media transport. A mitigation control is operative to mitigate print head damage in response to the signal.

In another aspect, a print head protection system is for use in connection with an inkjet printer having an inkjet print head, which is adapted for elevating (moving the jetting surface of the print head away from the media). A media sheet has a lead edge and a trail edge. The media sheet moves in a process direction along a process path. The print head protection system comprises a media transport for conveying the media sheet along the process path, and for holding the media sheet generally flat. The media transport includes a belt and a platen supporting the belt.

A plurality of acoustic sensors is disposed beneath the media transport and upstream of the print head. The acoustic sensors are arrayed transversely to the process direction. The acoustic sensors are adapted to acoustically measure a combined thickness of the belt and the platen and the media sheet. An analyzer is operatively connected to the acoustic sensors for analyzing the combined thickness of the belt and the platen and the media sheet. The analysis will detect if the media sheet is in contact with the media transport. The analysis will create an error signal when the media sheet is not in contact with the media transport. A mitigation control is operative to mitigate print head damage in response to the signal.

In yet another aspect, a method for print head protection is disclosed, and is for use in connection with an inkjet printer having an inkjet print head, which is adapted for elevating. A media sheet has a lead edge and a trail edge. The media sheet moves in a process direction along a process path. The method comprises providing a media transport adjacent the print head. The media sheet is conveyed along the process path on the media transport. The media sheet is held generally flat with the media transport.

At least one acoustic sensor is disposed beneath the media transport and upstream of the print head. A combined thickness of the media transport and the media sheet is measured acoustically with the acoustic sensor to determine a measured thickness. An analyzer is operatively connected to the acoustic sensor. The measured thickness is analyzed with the analyzer. This will detect if the media sheet is in contact with the media transport.

In the event that the media sheet is in contact with the media transport, printing is continued. When the media sheet is not in contact with the media transport, an error signal is created. A mitigation control is operatively connected to the analyzer. Potential print head damage will be mitigated in response to the signal.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
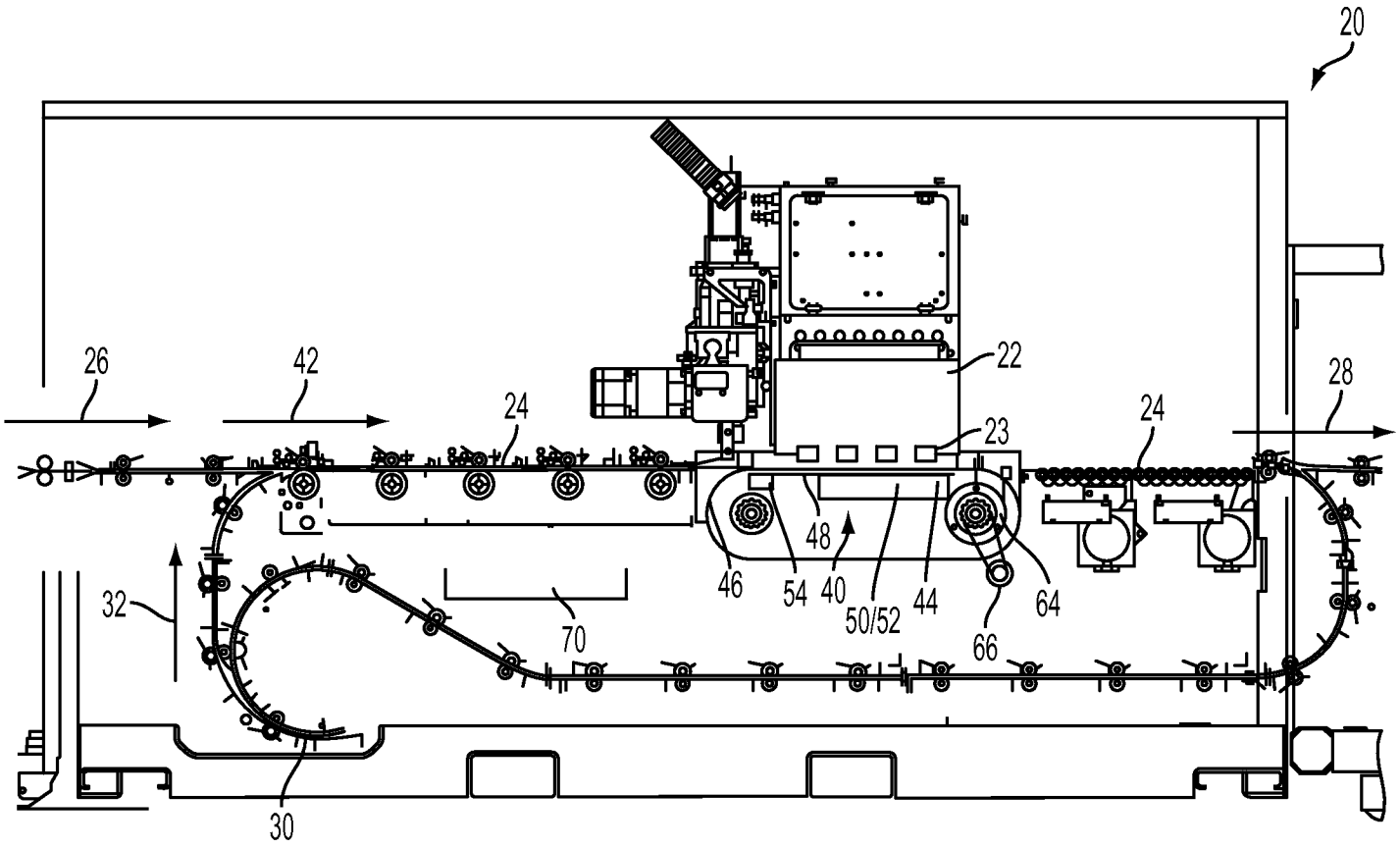
FIG. 1 is a schematic side elevational, sectional view of an exemplary production printer showing a print head protection system.
Figure 2:
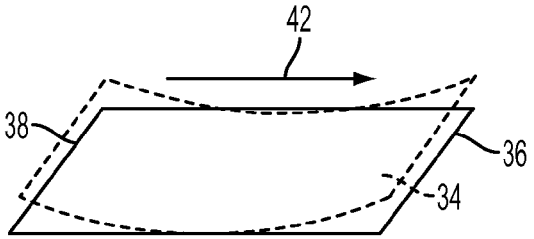
FIG. 2 is a schematic isometric view of a media sheet showing LE curl.
Figure 3:
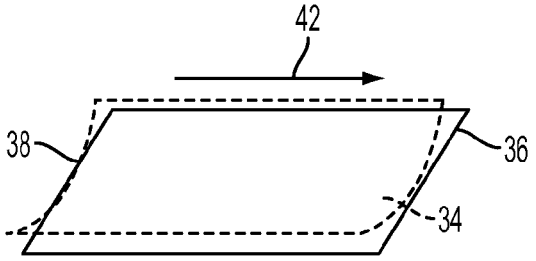
FIG. 3 is a schematic isometric view of a media sheet showing cross curl.
Figure 4:
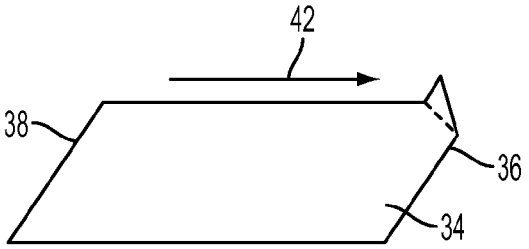
FIG. 4 is a schematic isometric view of a media sheet showing dog ear.
Figure 5:
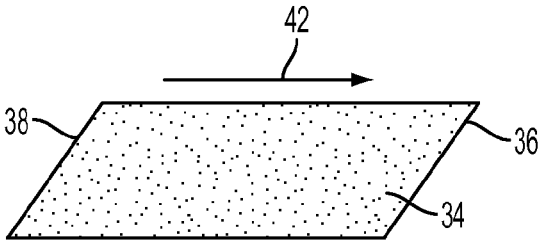
FIG. 5 is a schematic isometric view of a media sheet showing cockle.
Figure 6:
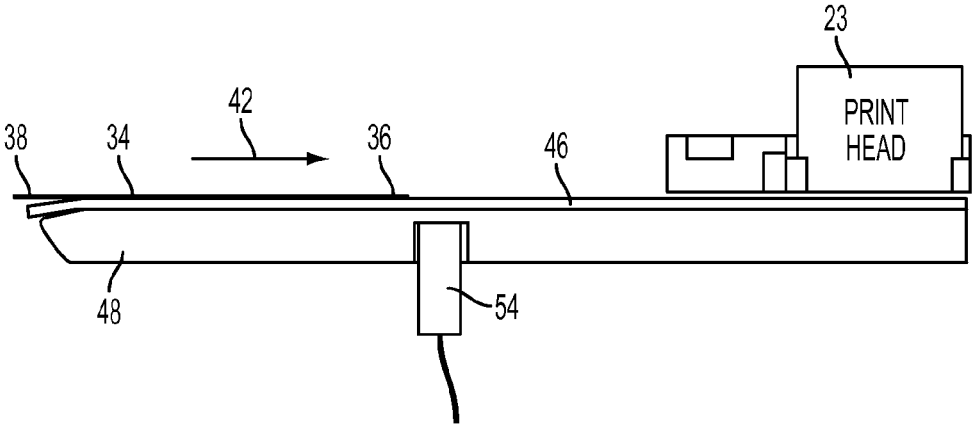
FIG. 6 is a schematic side elevational view of the print head protection system of FIG. 1 with an incoming media sheet, showing the sheet without curl.
Figure 7:
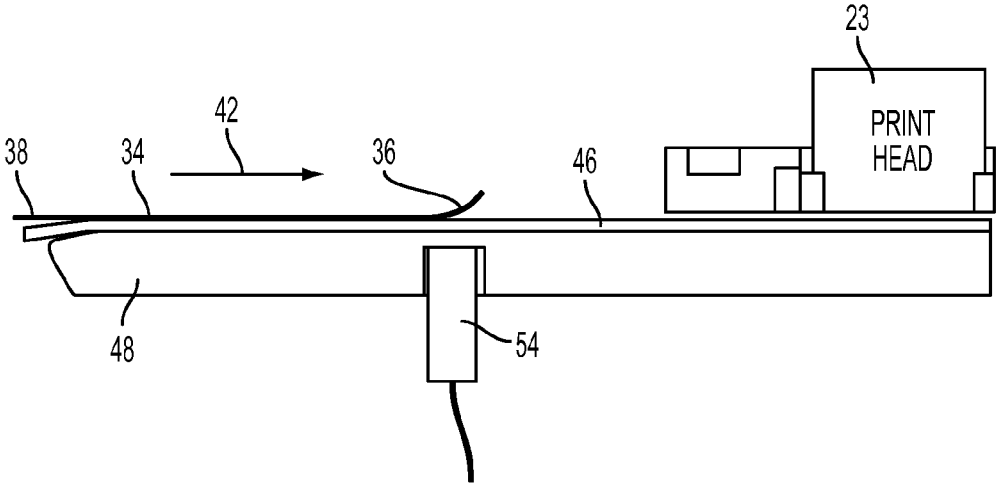
FIG. 7 is a schematic side elevational view of the print head protection system of FIG. 1 with an incoming media sheet, showing the sheet with curl.

Describing now in further detail these exemplary embodiments with reference to the Figures as described above, the print head protection system is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" LE of a media substrate refers to an edge of the sheet that is furthest downstream in the process direction. The "trailing edge" or "trail edge" TE is the upstream edge. LEF means long edge feed, wherein the side (longer of the two edges) of the letter moves in the process direction. SEF means short edge feed, wherein the end (shorter of the two edges) of the letter moves downstream.

As used herein, a "media handling assembly" refers to one or more devices used for handling and/or transporting media substrate, including feeding, printing, finishing, registration and transport systems. A media transport is a hold-down and conveying apparatus for moving the media along the process path. The media transport in the print zone or image transfer zone is instrumental in holding the media flat as it passes under the print heads. The media transport often utilizes a belt operating over a platen. To aid in holding the media flat either a vacuum or an electrostatic field is employed, sometimes both in combination.

As used herein, the terms "process" and "process direction" refer to a procedure of moving, transporting and/or handling a substrate media sheet. The process direction is a flow path the sheet moves in during the process.

As used herein, acoustic sensors are ultrasonic transducers capable of generating and sending out sound waves, and receiving the reflected sound waves. The signals are then analyzed to determine accurate thickness measurements through layers of dissimilar materials which are in intimate contact.

Referring to FIGS. 1 and 6-9, a print head protection system 40 is for use in connection with an inkjet printer 20 having an inkjet print head 23, or an array of print heads 23, which is located on a marking module or engine 22, which is adapted for elevating (moving the jetting surface of the print heads 23 upward, away from the media sheet 34). A media sheet 34 has a lead edge 36 and a trail edge 38. The media sheet 34 moves in a process direction (from left to right in the drawings) shown by arrow 42, along a process path 24 on a media sheet transport 44, such as a vacuum transport. Other transport devices are shown, such as nip rollers, and are well known to those skilled in the art.

The print head protection system 40 comprises a media transport 44 for conveying the media sheet 34 along the process path 24. The media transport 44 also holds the media sheet 34 generally flat. The media transport 44 typically includes a belt 46 and a platen 48 supporting the belt 46. The media transport 44 preferably includes a vacuum hold-down 50. However, the media transport 44 can include an electrostatic hold-down 52.

At least one acoustic sensor 54, and typically a plurality of acoustic sensors 54, is disposed beneath the media transport 44 and upstream of the print heads 23. The acoustic sensors 54 are arrayed transversely to the process direction 42 across the media transport 44. The acoustic sensors 54 are adapted to acoustically measure a combined thickness of the belt 46 and the platen 48 and the media sheet 34. An analyzer 56 is provided, including a computer 58 with a central processor and a memory. The analyzer 56 is well known to those skilled in the art, and is in common use in industry. The analyzer 56 is operatively connected to the acoustic sensors 54. The analyzer 56 will analyze and determine the combined thickness of the belt 46 and the platen 48 and the media sheet 34. The analysis will detect if the media sheet 34 is in contact with the media transport 44. In the usual case, the media sheet 34 will be in close contact with the media transport 44. If the media sheet 34 is not in intimate contact with the belt 46 at any given location over an acoustic sensor 54, that sensor would return only the thickness of the platen and the belt. In the event that the media sheet 34 is not in contact with the media transport 44, the analysis will create an error signal.

Figure 8:
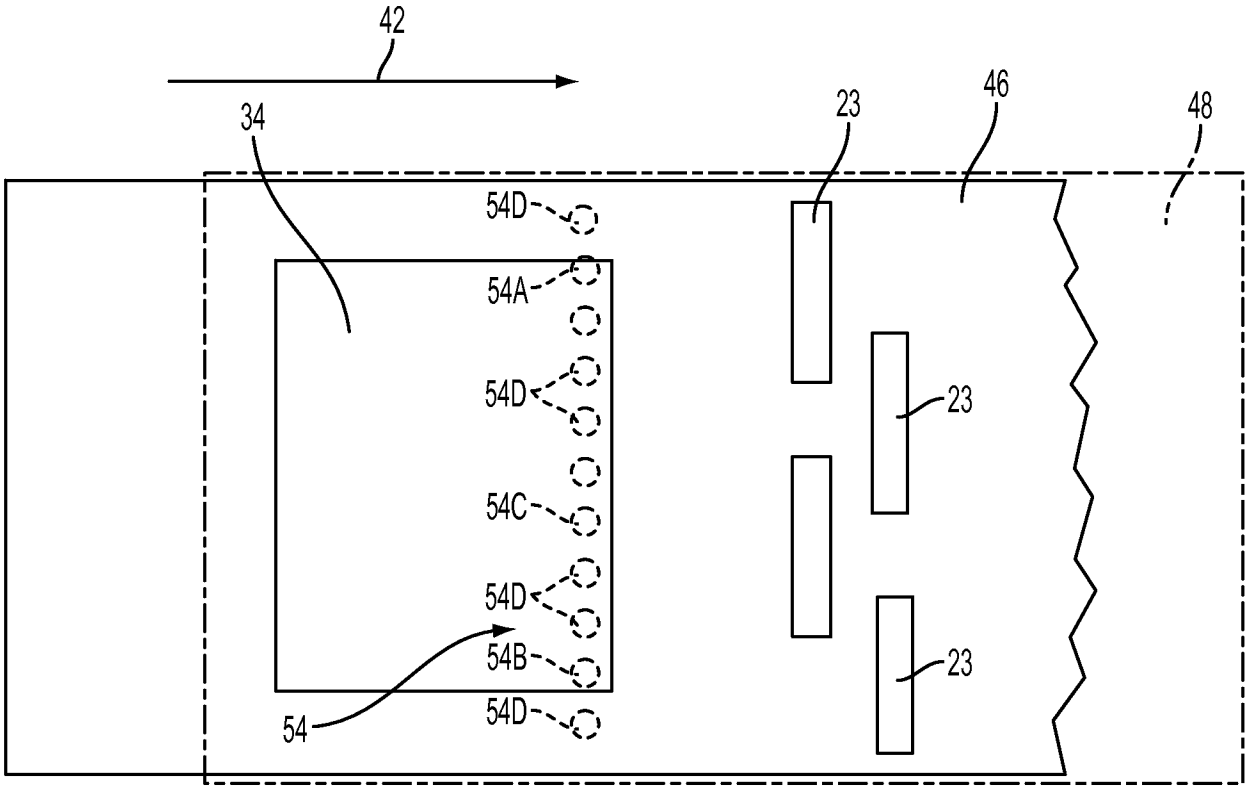
FIG. 8 is a schematic top plan view of the print head protection system of FIG. 1 with an incoming media sheet, showing the sheet with LEF.
Figure 9:
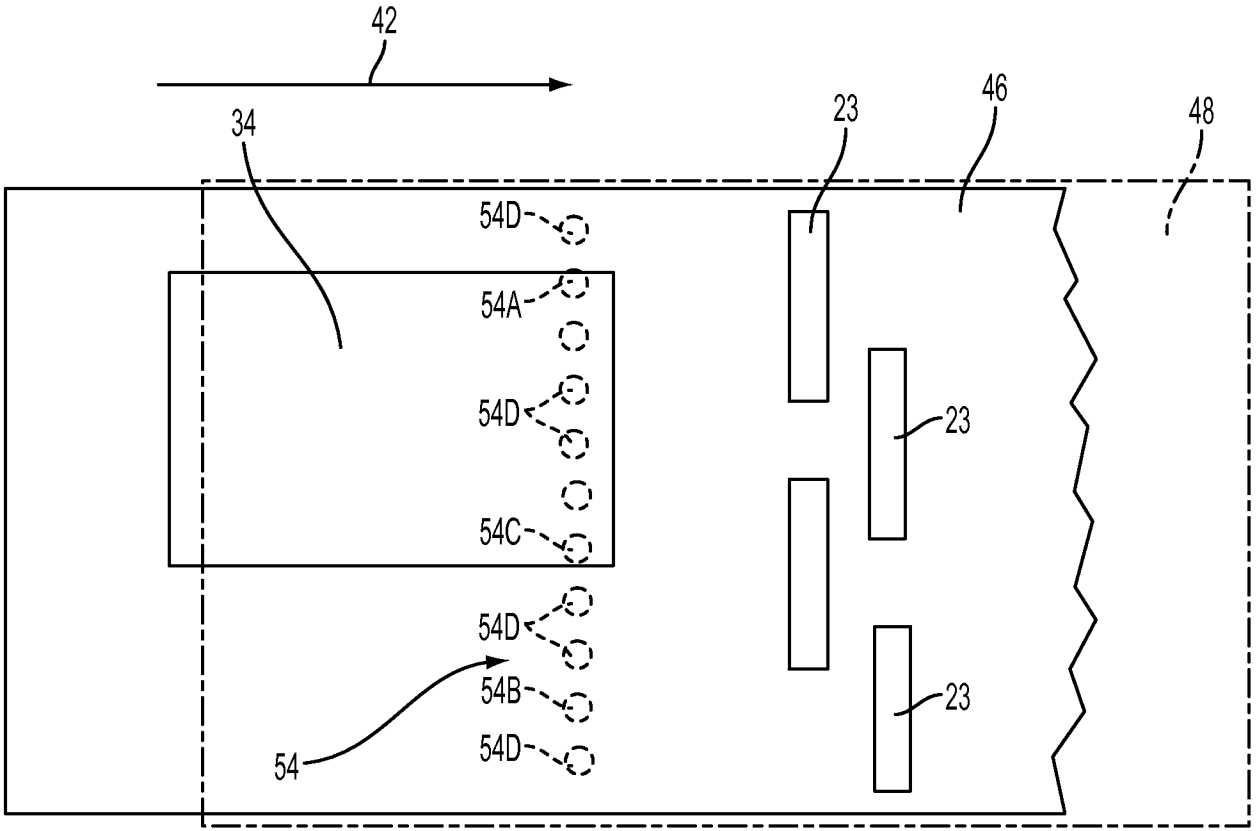
FIG. 9 is a schematic top plan view of the print head protection system of FIG. 1 with an incoming media sheet, showing the sheet with SEF.

The quantity and location of the acoustic sensors 54 could be based on raised media corners detection for various size ranges. The various kinds of raised corners and edges are shown in FIGS. 2-5. A typical sensor layout embodiment is shown in FIGS. 8 and 9. One outboard sensor 54A is common for all sizes and feeds. One sensor 54B is near the inboard edge for LEF letter size. One sensor 54C is near the inboard edge for SEF letter size. Additional sensors 54D are located at points in between, wherever sensors are needed. Such additional sensors 54D may be needed for larger sizes of media. It is to be understood that any number and location of acoustic sensors 54 is possible within the spirit and scope of the claims.

For each printing job with a given media type, the thickness and density of the media type will be input into the system. Test passes will be performed for each media type, and parameters for the media type will be stored in the analyzer memory to characterize that media type. For each sensor location, platen and belt thickness measurements will be recorded from each sensor to calibrate it. This information, combined with the media characteristics, provides a reference basis to calibrate the system for the specific media in use for a particular job.

A combined thickness of the media transport with each type of media is measured to determine a calibrated thickness for each type of media. The calibrated thickness is stored in the analyzer. During a job, the combined thickness of the media transport with each sheet of media is determined, yielding a measured thickness (of the combination) for that sheet. In the analyzer, the measured thickness of the sheet is then compared against the calibrated thickness for the media sheet type. When the measured thickness is generally the same as the calibrated thickness, the analyzer determines that the media sheet is in contact with the media transport. The sheet is sent downstream to the print heads. When the measured thickness is generally less than the calibrated thickness, the analyzer determines that the media sheet is not in contact with the media transport. The transport is stopped, and the sheet is discarded.

The analyzer 56 can be embodied in hardware and/or software. The analyzer 56 preferably includes a computer 58 and an algorithm 60 adapted to be executed on the computer 58. The algorithm 60 is well known to those skilled in the art, and is in common use commercially. The analyzer 56 receives data from the acoustic sensors 54, determines the total thickness of the components, and compares this with the target value. A media sheet 34 that lies flat within the plane of the process path 24, as is the desired case, will be sensed by the acoustic sensors 54. The analyzer 56 will determine that the combined thickness of the belt 46 and the platen 48 and the media sheet 34 is equal to that specified in the calibration of the system for the specific media in use. This indicates that the media sheet 34 is flat, and can safely pass beneath the print heads 23.

A media sheet 34 that is distorted out of the plane of the process path 24, as is the case with media sheet curl described above, will not be sensed by the acoustic sensors 54. This is due to the air space between the belt 46 and the media sheet 34. The analyzer 56 will determine that the combined thickness is less than that specified in the calibration of the system for the specific media in use. The analysis and calculation can be implemented with hardware and/or software. Preferably, the analysis is done digitally in the computer 58 by means well known to those having skill in the art.

A mitigation control 62 to prevent print head damage is provided. The mitigation control 62 is operative in response to the signal. The mitigation control 62 can be embodied in hardware and/or software, and is sensitive to any type of input signal. The mitigation control 62 can be operative of any mechanical element associated with the process path 24. The protection system 40 will be mounted significantly upstream of the marking module 22 (while still in the duplex path) such that a sheet determined to be out-of-spec by the system can be mitigated before coming in contact with the print heads 23.

The mitigation typically will include one of several procedures. Firstly, the mitigation control 62 can halt sheet feeding in response to the signal. The curled media sheet 34 is manually removed from the process path 24. Printing is then resumed.

Secondly, the media sheet 34 can be directed away from the process path 24 in response to the signal. The media sheet 34 is then moved to a tray 70 for waste. This can be done by reversing the belt 46 and diverting the media sheet 34 downward into a waste collection.

Thirdly, the print head 23 can be elevated in response to the signal. The curled sheet 34 then passes below the raised print heads 23, while receiving additional printing. The print head drawer (marking module 22), which is mounted on vertical slides, could be raised slightly (perhaps as much as 5 mm) to allow the out-of-spec paper to pass through without contacting the print heads 23. This results in slight distortion of the printed image, which is not necessarily objectionable. Since this system does not determine how far the media is raised above the process path plane, the paper could still impact the printing heads. Thus, elevating the print module is not the best option.

For each print, the thickness and density of the media type should be known by the system and could be characterized with test passes for each media type. For each sensor location, platen and belt thickness measurements could be recorded from each sensor to calibrate it. For each sheet of a printing job, the calibration is used to compare the measured thickness with the calibrated thickness. The analyzer will then determine if the media sheet is in contact with the transport.

An optional stepper drive motor 66 can be operatively connected to the belt transport drive pulley 64. A stepper control 68 is operatively connected to the stepper drive motor 66 and to the analyzer 56. Driving the belt 46 in this controlled manner would enable the system to map low points and high points as the belt loops. This would allow the system to compensate for belt variations and wear over time.

Figure 10:
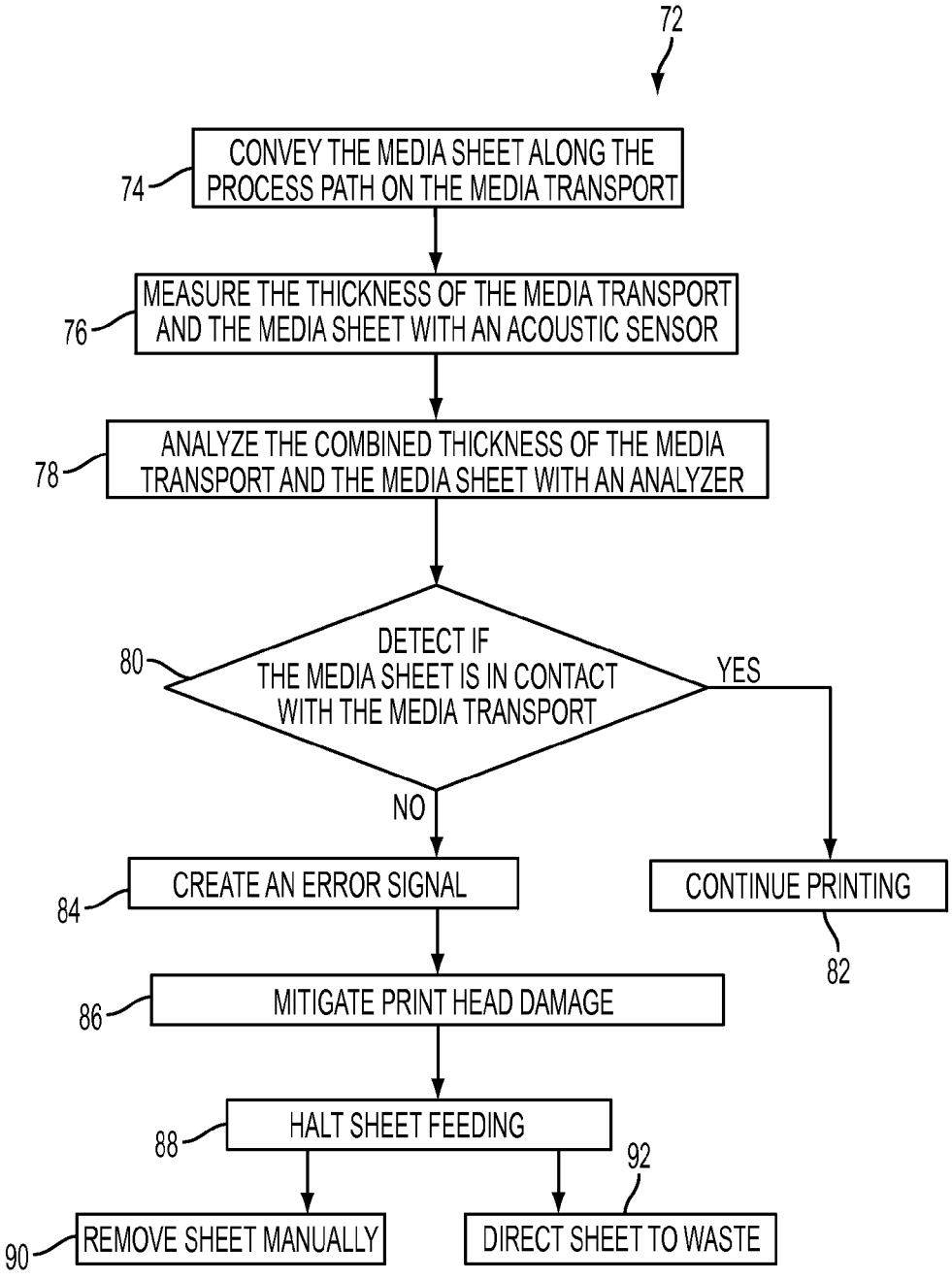
FIG. 10 is a flow chart of a method of the print head protection system of FIG. 1.
Figure 11:
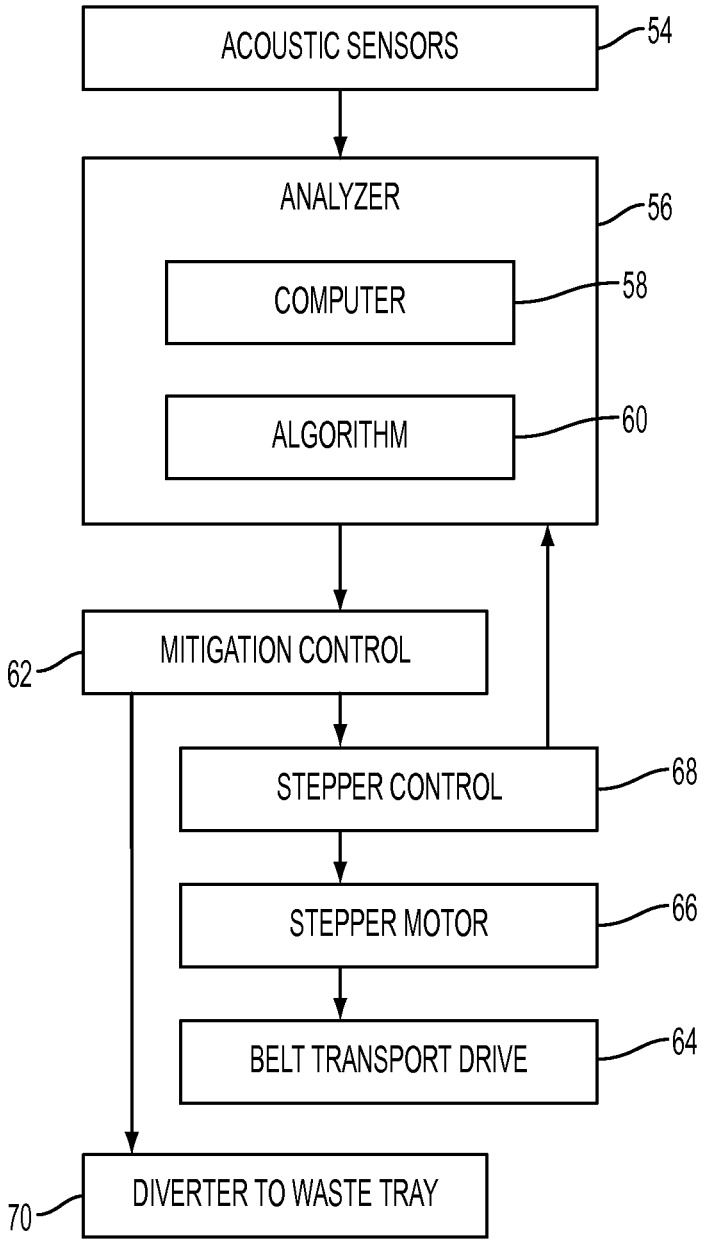
FIG. 11 is a block diagram of the print head protection system of FIG. 1.

A method for print head protection is disclosed, and is for use in connection with an inkjet printer 20 having an inkjet print head 23, which is adapted for elevating. A media sheet 34 has a lead edge 36 and a trail edge 38. The media sheet 34 moves in a process direction 42 along a process path 24. The steps are indicated on the flow chart FIG. 10, at 72. The method comprises providing a media transport 44 adjacent the print head 23. The media sheet 34 is conveyed along the process path 24 on the media transport 44 (step 74). The media sheet 34 is held generally flat with the media transport 44.

At least one acoustic sensor 54 is disposed beneath the media transport 44 and upstream of the print head 23. A combined thickness of the media transport 44 and the media sheet 34 is measured acoustically with the acoustic sensor 54 (step 76) to determine a measured thickness. An analyzer 56 is operatively connected to the acoustic sensor 54. The combined thickness of the media transport 44 and the media sheet 34 is analyzed with the analyzer 56 (step 78). This will detect if the media sheet is in contact with the media transport (step 80).

In the event that the media sheet 34 is in contact with the media transport 44, (if "yes") printing is continued (step 82). When the media sheet 34 is not in contact with the media transport 44, (if "no") an error signal is created (step 84). A mitigation control 62 is operatively connected to the analyzer 56. Potential print head damage will be mitigated in response to the signal (step 86). Sheet feeding is halted in response to the signal (step 88). The media sheet 34 can then be removed manually (step 90), or directed to a waste tray 70 (step 92).

A platen 48 is disposed beneath the print heads 23. The media transport 44 is provided with a belt 46, which carries the media sheet 34. The belt 46 moves in a continuous loop across the platen 48.

The belt 46 is driven operatively with a stepper drive motor 66. A stepper control 68 is operatively connected to the stepper drive motor 66 and to the analyzer 56. Low points and high points on the belt 46 are mapped with the stepper control 68 and the analyzer 56 as the belt loops. Belt variations and wear are thus compensated for over time.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A print head protection system for use in connection with an inkjet printer having an inkjet print head, the print head being adapted for elevating, and a media sheet having a lead edge and a trail edge, the media sheet moving in a process direction along a process path, the print head protection system comprising:

a media transport for conveying the media sheet along the process path, and for holding the media sheet generally flat;

at least one acoustic sensor disposed beneath the media transport and upstream of the print head, the acoustic sensor being adapted to acoustically measure a combined thickness of the media transport and the media sheet without contacting the media transport or media sheet;

an analyzer operatively connected to the acoustic sensor for analyzing the combined thickness of the media transport and the media sheet so as to detect if the media sheet is in contact with the media transport, the analyzer being adapted to create an error signal when the media sheet is not in contact with the media transport; and a mitigation control operative to mitigate print head damage in response to the signal.

2. The print head protection system of claim 1, wherein the media transport further comprises a platen.

3. The print head protection system of claim 2, wherein the media transport further comprises a belt moving across the platen.

4. The print head protection system of claim 3, further comprising:

a stepper drive motor operatively driving the belt; and a stepper control operatively connected to the stepper drive motor and to the analyzer, so as to enable the system to map low points and high points as the belt loops, to allow compensating for belt variations and wear over time.

5. The print head protection system of claim 1, wherein the media transport further comprises a vacuum hold-down.

6. The print head protection system of claim 1, wherein the mitigation control is adapted to halt sheet feeding in response to the signal.

7. The print head protection system of claim 1, wherein the mitigation control is adapted to direct the media sheet away from the process path in response to the signal.

8. The print head protection system of claim 1, wherein the mitigation control is adapted to elevate the print head in response to the signal.

9. A print head protection system for use in connection with an inkjet printer having an inkjet print head, the print head being adapted for elevating, and a media sheet having a lead edge and a trail edge, the media sheet moving in a process direction along a process path, the print head protection system comprising:

a media transport for conveying the media sheet along the process path, and for holding the media sheet generally flat, the media transport including a belt and a platen supporting the belt;

a plurality of acoustic sensors disposed beneath the media transport and upstream of the print head, the acoustic sensors being arrayed transversely to the process direction, the acoustic sensors being adapted to acoustically measure a combined thickness of the belt and the platen and the media sheet without contacting the media transport or media sheet;

an analyzer operatively connected to the acoustic sensors for analyzing the combined thickness of the belt and the platen and the media sheet so as to detect if the media sheet is in contact with the media transport, the analyzer being adapted to create an error signal when the media sheet is not in contact with the media transport; and a mitigation control operative to mitigate print head damage in response to the signal.

10. The print head protection system of claim 9, further comprising:

a stepper drive motor operatively driving the belt; and a stepper control operatively connected to the stepper drive motor and to the analyzer, so as to enable the system to map low points and high points as the belt loops, to compensate for belt variations and wear over time.

11. The print head protection system of claim 9, wherein the media transport further comprises a vacuum hold-down.

12. The print head protection system of claim 9, wherein the media transport further comprises an electrostatic hold-down.

13. The print head protection system of claim 9, wherein the mitigation control is adapted to halt sheet feeding in response to the signal.

14. The print head protection system of claim 9, wherein the mitigation control is adapted to direct the media sheet away from the process path in response to the signal.

15. The print head protection system of claim 9, wherein the mitigation control is adapted to elevate the print head in response to the signal.

16. A method for print head protection for use in connection with an inkjet printer having an inkjet print head, the print head being adapted for elevating, and a media sheet having a lead edge and a trail edge, the media sheet moving in a process direction along a process path, the method comprising:

providing a media transport adjacent the print head;

conveying the media sheet along the process path on the media transport;

holding the media sheet generally flat with the media transport;

disposing at least one acoustic sensor beneath the media transport and upstream of the print head;

measuring a combined thickness of the media transport and the media sheet acoustically with the acoustic sensor to determine a measured thickness without contacting the media transport or media sheet;

connecting an analyzer operatively to the acoustic sensor;

analyzing the measured combined thickness of the media transport and the media sheet with the analyzer;

detecting, based upon the measured combined thickness, if the media sheet is in contact with the media transport;

continuing printing in the event that the media sheet is in contact with the media transport;

creating an error signal when the media sheet is not in contact with the media transport;

connecting a mitigation control operatively to the analyzer; and mitigating print head damage with the mitigation control in response to the error signal.

17. The method of claim 16, further comprising:

measuring a combined thickness of the media transport with each type of media to determine a calibrated thickness for each type of media, and storing the calibrated thickness in the analyzer;

comparing the measured thickness against the calibrated thickness with the analyzer for the media sheet;

determining that the media sheet is in contact with the media transport when the measured thickness is generally the same as the calibrated thickness; and determining that the media sheet is not in contact with the media transport when the measured thickness is generally less than the calibrated thickness.

18. The method of claim 16, wherein the disposing at least one acoustic sensor further comprises:

disposing a plurality of acoustic sensors beneath the media transport and upstream of the print head; and arraying the acoustic sensors transversely to the process direction.

19. The method of claim 16, further comprising:

providing the media transport with a platen;

providing the media transport with a belt for supporting the media sheet; and moving the belt across the platen.

20. The method of claim 19, further comprising:

driving the belt operatively with a stepper drive motor;

connecting a stepper control operatively to the stepper drive motor and to the analyzer;

mapping low points and high points with the stepper control and the analyzer as the belt loops; and compensating for belt variations and wear over time.

21. The method of claim 16, wherein the mitigating print head damage further comprises halting sheet feeding in response to the signal.

22. The method of claim 16, wherein the mitigating print head damage further comprises directing the media sheet away from the process path in response to the signal.

23. The print head protection system of claim 1, wherein the media transport further comprises an electrostatic hold-down.

* * * * *